US010649357B2

(12) United States Patent
Nannichi et al.

(10) Patent No.: US 10,649,357 B2
(45) Date of Patent: May 12, 2020

(54) METHOD FOR PRODUCING LIQUID DEVELOPER

(71) Applicant: Kao Corporation, Tokyo (JP)

(72) Inventors: Yuri Nannichi, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 16/468,103

(22) PCT Filed: Nov. 2, 2017

(86) PCT No.: PCT/JP2017/039751
§ 371 (c)(1),
(2) Date: Jun. 10, 2019

(87) PCT Pub. No.: WO2018/116658
PCT Pub. Date: Jun. 28, 2018

(65) Prior Publication Data

US 2020/0064752 A1 Feb. 27, 2020

(30) Foreign Application Priority Data

Dec. 22, 2016 (JP) ..... 2016-249023

(51) Int. Cl.
*G03G 9/00* (2006.01)
*G03G 9/13* (2006.01)
(Continued)

(52) U.S. Cl.
CPC ..... *G03G 9/132* (2013.01); *G03G 9/125* (2013.01); *G03G 15/10* (2013.01)

(58) Field of Classification Search
CPC ..... G03G 9/132; G03G 9/125
(Continued)

(56) References Cited

U.S. PATENT DOCUMENTS 5,536,615 A 7/1996 Hopper et al.
5,780,196 A 7/1998 Toshimitsu et al.
(Continued)

FOREIGN PATENT DOCUMENTS

JP 9-179354 A 7/1997
JP 2006-251253 A 9/2006
(Continued)

OTHER PUBLICATIONS

International Search Report dated Feb. 6, 2018 in PCT/JP2017/039751.

*Primary Examiner* — Mark A Chapman
(74) *Attorney, Agent, or Firm* — Oblon, McClelland, Maier & Neustadt, L.L.P.

(57) ABSTRACT

A method for producing a liquid developer containing a resin binder containing a resin having an acidic group, a colorant, a basic dispersant, and an insulating liquid, including: step I: stirring raw materials containing the resin binder, the colorant, and the basic dispersant at a temperature of equal to or higher than a glass transition temperature of the resin binder; and step II: adding dropwise from 50 to 500 parts by mass of the insulating liquid to a stirred mixture of the step I, based on 100 parts by mass of the stirred mixture at a temperature of equal to or higher than a glass transition temperature of the resin binder, thereby carrying out a phase inversion emulsification, to provide a dispersion of toner particles. The liquid developer obtainable by the method of the present invention is suitably used in development or the like of latent images formed in, for example, electrophotography, electrostatic recording method, electrostatic printing method or the like.

20 Claims, 2 Drawing Sheets

(51) Int. Cl.
*G03G 9/125* (2006.01)
*G03G 15/10* (2006.01)

(58) Field of Classification Search
USPC ..... 430/137.22
See application file for complete search history.

(56) References Cited

U.S. PATENT DOCUMENTS

| | | | |
|---|---|---|---|
| 2010/0323291 | A1 | 12/2010 | Hirohito et al. |
| 2014/0093821 | A1 | 4/2014 | Tsutomu et al. |
| 2019/0107794 | A1 | 4/2019 | Yuzo et al. |

FOREIGN PATENT DOCUMENTS

| | | | |
|---|---|---|---|
| JP | 2008-96646 | A | 4/2008 |
| JP | 2014-71370 | A | 4/2014 |
| JP | 2015-125297 | A | 7/2015 |
| JP | 2017-67952 | A | 4/2017 |
| JP | 2017-223791 | A | 12/2017 |
| WO | WO 2009/041634 | A1 | 4/2009 |

METHOD FOR PRODUCING LIQUID DEVELOPER

FIELD OF THE INVENTION

The present invention relates to a method for producing a liquid developer usable in development of latent images formed in, for example, electrophotography, electrostatic recording method, electrostatic printing method or the like.

BACKGROUND OF THE INVENTION

Electrophotographic developers are a dry developer in which toner components composed of materials containing a colorant and a resin binder are used in a dry state, and a liquid developer in which toner components are dispersed in an insulating liquid.

In a liquid developer, toner particles are dispersed in oil in an insulating liquid, thereby making it possible to form smaller particle sizes as compared to a dry developer. Therefore, high-quality printouts can be obtained surpassing offset printing, so that the liquid developer is suitable for applications in commercial printings. In addition, in the recent years, since the demands for speeding up have been increasing, liquid developers in which toner particles having smaller particle sizes and reduced viscosities are stably dispersed therein have been desired. Also, a liquid developer in which toner particles are melt-fusable with a smaller amount of heat, in other words, a liquid developer having a low-temperature fusing ability, has been desired.

Patent Publication 1 discloses a method for producing a liquid developer utilizing a coacervation method, the method for producing a liquid developer characterized in that the method includes dispersing colored resin particles in an insulating hydrocarbon-based dispersion medium in the presence of a particle dispersant, which is a reaction product of a polyamine compound and a hydroxycarboxylic acid self-condensate, and an acidic group-containing resin.

Patent Publication 2 discloses a method for producing a liquid developer including the steps of adding a colored resin to a nonpolar dispersion medium, heating the nonpolar dispersion medium to a temperature of equal to or higher than a softening point of the resin, stirring the nonpolar dispersion medium to which the resin is added and heated to form a resin emulsion, and cooling the resin emulsion to solidify colored fine resin particles.

Patent Publication 3 discloses a method for producing a liquid developer in which toner particles are dispersed in an insulating liquid, characterized in that the method includes a molten mixture dispersion preparation step of preparing a molten mixture dispersion in which the kneaded mixture is finely dispersed in a molten state in the insulating liquid using a kneaded mixture containing a colorant and resin materials, and a cooling step of cooling the molten mixture dispersion to solidify the kneaded mixture in a molten state, wherein the insulating liquid is mainly composed of a non-volatile hydrocarbon.

Patent Publication 1: WO 2009/041634

Patent Publication 2: Japanese Patent Laid-Open No. Hei-09-179354

Patent Publication 3: Japanese Patent Laid-Open No. 2006-251253

SUMMARY OF THE INVENTION

The present invention relates to:

[1] a method for producing a liquid developer containing a resin binder containing a resin having an acidic group, a colorant, a basic dispersant, and an insulating liquid, including:

step I: stirring raw materials containing the resin binder, the colorant, and the basic dispersant at a temperature of equal to or higher than a glass transition temperature of the resin binder; and step II: adding dropwise from 50 to 500 parts by mass of the insulating liquid to a stirred mixture of the step I, based on 100 parts by mass of the stirred mixture at a temperature of equal to or higher than a glass transition temperature of the resin binder, thereby carrying out a phase inversion emulsification, to provide a dispersion of toner particles; and

[2] a method for producing a liquid developer containing a resin binder containing a resin having an acidic group, a colorant, a basic dispersant, and an insulating liquid, including:

step i: stirring raw materials containing the resin binder and the basic dispersant at a temperature of equal to or higher than a glass transition temperature of the resin binder;

step ii: adding dropwise from 50 to 500 parts by mass of the insulating liquid to a stirred mixture of the step i, based on 100 parts by mass of the stirred mixture at a temperature of equal to or higher than a glass transition temperature of the resin binder, thereby carrying out a phase inversion emulsification, to provide a dispersion of toner particles; and step iii: mixing the dispersion obtained in the step ii with the colorant.

DETAILED DESCRIPTION OF THE INVENTION

Figure 1:
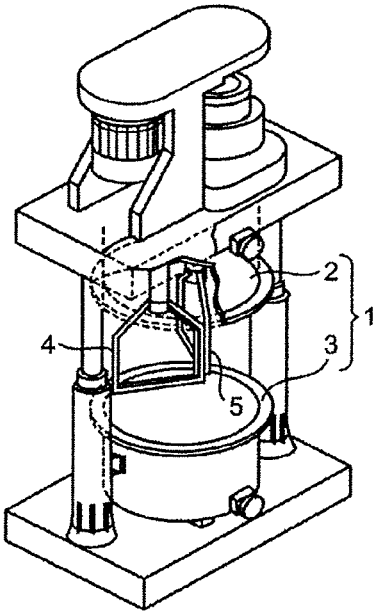
FIG. 1 A perspective view showing one example of a planetary mixer.

In the method for producing a liquid developer in which toner particles are formed according to a coacervation method as in Patent Publication 1, the formation of smaller particles of the toner particles is not sufficient. In addition, in the methods for producing a liquid developer in which toner particles are formed according to a forced emulsification by a mechanical stirring force as in Patent Publications 2 and 3, costs increase in the implement of the agitation apparatus.

The present invention relates to a method capable of conveniently producing a liquid developer having smaller particle sizes of toner particles and reduced viscosity without using specialized instruments or organic solvents.

According to the method of the present invention, a liquid developer having smaller particle sizes of toner particles and reduced viscosity can be conveniently produced without using specialized instruments or organic solvents. In addition, the liquid developer obtained by the method of the present invention also has excellent low-temperature fusing ability and dispersion stability.

The present invention is a method for producing a liquid developer containing a resin binder containing a resin having an acidic group, a colorant, a basic dispersant, and an insulating liquid according to steps I and II described later, and according to the method of the present invention, a liquid developer having smaller particle sizes of toner particles and reduced viscosity can be conveniently produced without using specialized instruments or organic solvents.

The step I is a step of stirring raw materials containing the resin binder, the colorant, and the basic dispersant at a temperature of equal to or higher than a glass transition temperature of the resin binder.

The resin binder contains a resin having an acidic group. The resin having an acidic group can be adsorbed by a basic dispersant by acid-base interactions, thereby improving dispersibility of the resin in an insulating liquid.

The acidic group includes a carboxy group, a sulfo group, a phosphate group, and the like, among which a carboxy group is preferred, from the viewpoint of dispersion stability of the toner particles and availability.

Therefore, it is preferable that the resin having an acidic group contains a polyester-based resin.

The polyester-based resin includes polyester resins, composite resins containing polyester resins and styrenic resins, and the like.

In the present invention, it is preferable that the polyester resin is a polycondensate of an alcohol component containing a dihydric or higher polyhydric alcohol and a carboxylic acid component containing a dicarboxylic or higher polycarboxylic acid compound.

The dihydric alcohol includes, for example, aliphatic diols having 2 or more carbon atoms and 20 or less carbon atoms, and preferably having 2 or more carbon atoms and 15 or less carbon atoms; an alkylene oxide adduct of bisphenol A represented by the formula (I):

(I)

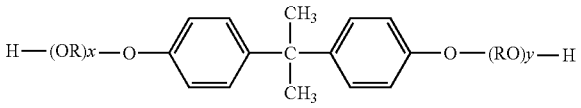

wherein OR and RO are an oxyalkylene group, wherein R is an ethylene group and/or a propylene group; and each of x and y is a positive number showing an average number of moles of alkylene oxide added, wherein a value of the sum of x and y is 1 or more, and preferably 1.5 or more, and 16 or less, preferably 8 or less, more preferably 6 or less, and even more preferably 4 or less. Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably an alkylene oxide adduct of bisphenol A represented by the formula (I) and/or 1,2-propanediol, from the viewpoint of improving pulverizability of the toner, thereby obtaining toner particles having a smaller particle size, from the viewpoint of improving low-temperature fusing ability of the liquid developer, and from the viewpoint of improving dispersion stability of the toner particles, thereby improving storage stability. The alkylene oxide adduct of bisphenol A represented by the formula (I) is more preferred, from the viewpoint of pulverizability. Also, 1,2-propanediol is more preferred, from the viewpoint of storage stability. The content of the alkylene oxide adduct of bisphenol A represented by the formula (I) or 1,2-propanediol is preferably 50% by mol or more, more preferably 70% by mol or more, even more preferably 90% by mol or more, even more preferably 95% by mol or more, and even more preferably 100% by mol, of the alcohol component. When 1,2-propanediol and the alkylene oxide adduct of bisphenol A represented by the formula (I) are used together, it is preferable that a total content of both is within the above range.

The trihydric or higher polyhydric alcohol includes trihydric or higher polyhydric alcohols having 3 or more carbon atoms and 20 or less carbon atoms, and preferably having 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, or anhydrides thereof, derivatives thereof such as alkyl esters of which alkyl group has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and succinic acid substituted with an alkyl group having 1 or more carbon atoms and 20 or less carbon atoms or with an alkenyl group having 2 or more carbon atoms and 20 or less carbon atoms.

The carboxylic acid component is preferably terephthalic acid and/or fumaric acid, and more preferably fumaric acid, from the viewpoint of improving low-temperature fusing ability of the toner, and from the viewpoint of improving dispersion stability of the toner particles, thereby improving storage stability. The content of the terephthalic acid or fumaric acid or a total content of terephthalic acid and fumaric acid is preferably 40% by mol or more, more preferably 50% by mol or more, even more preferably 70% by mol or more, even more preferably 90% by mol or more, even more preferably 95% by mol or more, and even more preferably 100% by mol, of the carboxylic acid component.

The tricarboxylic or higher polycarboxylic acid compound includes, for example, tricarboxylic or higher polycarboxylic acids having 4 or more carbon atoms and 20 or less carbon atoms, preferably having 6 or more carbon atoms and 20 or less carbon atoms, more preferably having 7 or more carbon atoms and 15 or less carbon atoms, even more preferably having 8 or more carbon atoms and 12 or less carbon atoms, and even more preferably having 9 or more carbon atoms and 10 or less carbon atoms, or anhydrides thereof, derivatives thereof such as alkyl esters of which alkyl has 1 or more carbon atoms and 3 or less carbon atoms and the like. Specific examples include 1,2,4-benzenetricarboxylic acid (trimellitic acid), 1,2,4,5-benzenetetracarboxylic acid (pyromellitic acid), or acid anhydrides thereof, and the like.

The content of the tricarboxylic or higher polycarboxylic acid compound is preferably 40% by mol or less, more preferably 30% by mol or less, even more preferably 20% by mol or less, even more preferably 10% by mol or less, and even more preferably 5% by mol or less, of the carboxylic acid component, from the viewpoint of low-temperature fusing ability.

Here, the alcohol component may contain a monohydric alcohol, and the carboxylic acid component may contain a monocarboxylic acid compound in proper amounts, from the viewpoint of adjusting a molecular weight and a softening point of the polyester resin.

The equivalent ratio of the carboxylic acid component to the alcohol component in the polyester resin, i.e. COOH group or groups/OH group or groups, is preferably 0.6 or more, more preferably 0.7 or more, and even more preferably 0.75 or more, and preferably 1.1 or less, and more preferably 1.05 or less, from the viewpoint of adjusting a softening point of the polyester resin.

The polyester resin can be produced, for example, by polycondensing the alcohol component and the carboxylic acid component in an inert gas atmosphere at a temperature of 130° C. or higher, and preferably 170° C. or higher, and 250° C. or lower, and preferably 240° C. or lower, preferably in the presence of an esterification catalyst, further optionally in the presence of an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like, and the tin compounds are preferred. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes t-butyl catechol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

Here, in the present invention, the polyester-based resin may be a modified polyester resin to an extent that the properties thereof are not substantially impaired. The modified polyester resin includes, for example, a polyester resin grafted or blocked with a phenol, a urethane, an epoxy or the like according to a method described in Japanese Patent Laid-Open No. Hei-11-133668, Hei-10-239903, Hei-8-20636, or the like. Among the modified polyester resins, urethane-modified polyester resins in which polyester resins are urethane-extended with a polyisocyanate compound are preferred.

The softening point of the resin having an acidic group is preferably 70° C. or higher, and more preferably 75° C. or higher, from the viewpoint of improving dispersion stability of the toner particles, thereby improving storage stability, and the softening point is preferably 160° C. or lower, more preferably 130° C. or lower, even more preferably 120° C. or lower, and even more preferably 110° C. or lower, from the viewpoint of improving low-temperature fusing ability of the liquid developer.

The glass transition temperature of the resin having an acidic group is preferably 40° C. or higher, and more preferably 45° C. or higher, from the viewpoint of improving dispersion stability of the toner particles, thereby improving storage stability, and the glass transition temperature is preferably 80° C. or lower, more preferably 70° C. or lower, and even more preferably 60° C. or lower, from the viewpoint of improving low-temperature fusing ability.

The acid value of the resin having an acidic group is preferably 3 mgKOH/g or more, more preferably 5 mgKOH/g or more, and even more preferably 8 mgKOH/g or more, and preferably 60 mgKOH/g or less, more preferably 50 mgKOH/g or less, even more preferably 40 mgKOH/g or less, and even more preferably 30 mgKOH/g or less, from the viewpoint of reducing viscosity of the liquid developer, and from the viewpoint of improving dispersion stability of the toner particles, thereby improving storage stability. The acid value of the resin having an acidic group can be adjusted by a method such as varying an equivalent ratio of the carboxylic acid component to the alcohol component, varying a reaction time during the production of the resin, or varying the content of the tricarboxylic or higher polycarboxylic acid compound.

The content of the resin having an acidic group in the resin binder is preferably 90% by mass or more, more preferably 95% by mass or more, and even more preferably 100% by mass, i.e. only the polyester-based resin is used. However, other resin besides the resin having an acidic group may be contained within the range that would not impair the effects of the present invention. The resins besides the resin having an acidic group include, for example, one or more members selected from resins such as styrenic resins which are homopolymers or copolymers containing styrene or styrene substitutes, such as polystyrenes, styrene-propylene copolymers, styrene-butadiene copolymers, and styrene-vinyl chloride copolymers, epoxy resins, polyethylene-based resins, polypropylene-based resins, polyurethane-based resins, silicone resins, phenol resins, and aliphatic or alicyclic hydrocarbon resins.

As the colorant, dyes, pigments and the like which are used as colorants for toners can be used. Examples include carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, and the like. In the present invention, the toner particles may be any one of black toners and color toners.

The amount of the colorant used in the step I is preferably 5 parts by mass or more, more preferably 10 parts by mass or more, and even more preferably 15 parts by mass or more, based on 100 parts by mass of the resin binder, from the viewpoint of improving optical density, and the amount used is preferably 100 parts by mass or less, more preferably 70 parts by mass or less, even more preferably 50 parts by mass or less, and even more preferably 25 parts by mass or less, based on 100 parts by mass of the resin binder, from the viewpoint of improving pulverizability of the toner, thereby forming smaller particle sizes, from the viewpoint of improving low-temperature fusing ability, and from the viewpoint of improving dispersion stability of the toner particles, thereby improving storage stability.

It is preferable that the basic dispersant has a basic nitrogen-containing group, from the viewpoint of high adsorbability to the resin having an acidic group. The basic nitrogen-containing group is preferably at least one member selected from the group consisting of amino groups (—$NH_2$, —NHR, —NHRR'), an amide group (—C(=O)—NRR'), an imide group (—$N(COR)_2$), a nitro group (—$NO_2$), an imino group (=NH), a cyano group (—CN), an azo group (—N=N—), a diazo group (=$N_2$), and an azide group (—$N_3$). Here, R or R' is a hydrocarbon group having from 1 to 5 carbon atoms. The amino groups and/or the imino group is preferred, from the viewpoint of adsorbability of the dispersant to the toner particles, and the imino group is more preferred, from the viewpoint of chargeability of the toner particles.

The functional group contained besides the basic nitrogen-containing group includes, for example, a hydroxy group, a formyl group, an acetal group, an oxime group, a thiol group, and the like.

The proportion of the basic nitrogen-containing group occupying the basic dispersant, as calculated in terms of the number of heteroatoms, is preferably 70% by number or more, more preferably 80% by number or more, even more preferably 90% by number or more, even more preferably 95% by number or more, and even more preferably 100% by number, from the viewpoint of dispersion stability.

It is preferable that the basic dispersant contains a group derived from a hydrocarbon having 16 or more carbon atoms, a hydrocarbon having 16 or more carbon atoms partly substituted with a halogen atom, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms, or a polyolefin (hereinafter also referred to as "dispersible group"), from the viewpoint of dispersibility of the liquid developer.

The hydrocarbon having 16 or more carbon atoms is preferably a hydrocarbon having 16 or more carbon atoms and 24 or less carbon atoms, which includes, for example, hexadecene, octadecene, eicosane, docosane, and the like.

The hydrocarbon having 16 or more carbon atoms partly substituted with a halogen atom is preferably a hydrocarbon having 16 or more carbon atoms and 24 or less carbon atoms partly substituted with a halogen atom, which includes, for example, chlorohexadecane, bromohexadecane, chlorooctadecane, bromooctadecane, chloroeicosane, bromoeicosane, chlorodocosane, bromodocosane, and the like.

The hydrocarbon having 16 or more carbon atoms having a reactive functional group is preferably a hydrocarbon having 16 or more carbon atoms and 24 or less carbon atoms having a reactive functional group, which includes, for example, hexadecenylsuccinic acid, octadecenylsuccinic acid, eicosenylsuccinic acid, docosenylsuccinic acid, hexadecyl glycidyl ether, octadecyl glycidyl ether, eicosyl glycidyl ether, docosyl glycidyl ether, and the like.

The polymer of a hydroxycarboxylic acid having 16 or more carbon atoms is preferably a polymer of a hydroxycarboxylic acid having 16 or more carbon atoms and 24 and less carbon atoms, which includes, for example, a polymer of 18-hydroxystearic acid, and the like.

The polymer obtained from a dibasic acid having 2 or more carbon atoms and 22 or less carbon atoms and a diol having 2 or more carbon atoms and 22 or less carbon atoms includes, for example, a polymer obtained from ethylene glycol and sebacic acid, a polymer obtained from 1,4-butanediol and fumaric acid, a polymer obtained from 1,6-hexanediol and fumaric acid, a polymer obtained from 1,10-decanediol and sebacic acid, a polymer obtained from 1,12-dodecanediol and 1,12-dodecanedionic acid, and the like.

The polymer of an alkyl (meth)acrylate having 16 or more carbon atoms is preferably a polymer of an alkyl (meth) acrylate having 16 or more carbon atoms and 24 or less carbon atoms, which includes, for example, a polymer of hexadecyl methacrylate, a polymer of octadecyl methacrylate, a polymer of docosyl methacrylate, and the like.

The polyolefin includes, for example, polyethylene, polypropylene, polybutylene, polyisobutene, polymethylpentene, polytetradecene, polyhexadecene, polyoctadecene, polyeicosene, polydocosene, and the like.

The basic dispersant preferably has a polyolefin unit, and more preferably having a polypropylene unit and/or a polyisobutene unit, from the viewpoint of dispersibility of the toner particles, and the basic dispersant even more preferably has a polypropylene unit, from the viewpoint of raising the melting point of the dispersant. Therefore, among the above dispersible groups, a group derived from a polyolefin is preferred, a group derived from polypropylene and/or a group derived from polyisobutene is more preferred, and a group derived from polypropylene is even more preferred.

The basic dispersant is not particularly limited, and obtained by, for example, reacting raw materials for a basic nitrogen-containing group and raw materials for a dispersible group.

The raw materials for a basic nitrogen-containing group include polyalkyleneimines such as polyethyleneimines, polyallylamines, polyaminoalkyl methacrylates such as poly (dimethylaminoethyl) methacrylates, and the like.

The number-average molecular weight of the raw materials for a basic nitrogen-containing group is preferably 100 or more, more preferably 500 or more, and even more preferably 1,000 or more, from the viewpoint of adsorbability to an acidic group owned by a resin, and the number-average molecular weight is preferably 15,000 or less, more preferably 10,000 or less, and even more preferably 5,000 or less, from the viewpoint of dispersibility of the toner particles.

The raw materials for a dispersible group include a halogenated hydrocarbon having 16 or more carbon atoms, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms having a reactive functional group, a polyolefin having a reactive functional group, and the like. Among them, the halogenated hydrocarbon having 16 or more carbon atoms, the hydrocarbon having 16 or more carbon atoms having a reactive functional group, the polymer of an alkyl (meth)acrylate having 16 or more carbon atoms and 24 or less carbon atoms having a reactive functional group, or a polyolefin having a reactive functional group is preferred, from the viewpoint of availability and reactivities of the raw materials. The reactive functional group includes a carboxy group, an epoxy group, a formyl group, an isocyanate group, and the like, among which a carboxy group or an epoxy group is preferred, from the viewpoint of safety and reactivity. Therefore, it is preferable that the compound having a reactive functional group is a carboxylic acid-based compound. The carboxylic acid-based compound includes fumaric acid, maleic acid, ethanoic acid, propanoic acid, butanoic acid, succinic acid, oxalic acid, malonic acid, tartaric acid, anhydrides thereof, or alkyl esters thereof of which alkyl has 1 or more carbon atoms and 3 or less carbon atoms, and the like. Specific examples of the raw materials for a dispersible group include halogenated alkanes such as chlorooctadecane, epoxy-modified polyoctadecyl methacrylate, polyethylene succinic anhydride, chlorinated polypropylene, polypropylene succinic anhydride, polyisobutene succinic anhydride, and the like.

The content of the compound having a polyolefin unit in the raw materials for a dispersible group is preferably 70% by mass or more, more preferably 80% by mass or more, even more preferably 90% by mass or more, and even more preferably 100% by mass, from the viewpoint of dispersibility of the toner particles.

The raw materials for a dispersible group having a polypropylene unit include, for example, UMEX 100TS, UMEX 110TS, UMEX 1001, and UMEX 1010, hereinabove manufactured by Sanyo Chemical Industries, Ltd.; HARDLEN 13-LP, HARDLEN 13-LLP, HARDLEN 14-LWP, HARDLEN 15-LP, HARDLEN 15-LLP, HARDLEN 16-LP, HARDLEN DX-526P, HARDLEN CY-9122P, HARDLEN CY-9124P, HARDLEN HM-21P, HARDLEN M-28P, HARDLEN F-2P, HARDLEN F-6P, TOYO-TAC M-100, TOYO-TAC M-300, TOYO-TAC M-312, TOYO-TAC PMA H1000P, and TOYO-TAC PMA-F2, hereinabove manufactured by TOYOBO CO., LTD.; SUPERCHLON C, SUPERCHLON L-206, SUPERCHLON 813A, SUPERCHLON 803M, SUPERCHLON 803MW, SUPERCHLON 803LT, SUPERCHLON 1026, SUPERCHLON 803L, SUPERCHLON 814H, SUPERCHLON 390S, SUPERCHLON 814B, SUPERCHLON 360T, SUPERCHLON 370M, SUPERCHLON 2027 MB, SUPERCHLON 822, SUPERCHLON 892L, SUPERCHLON 930, SUPERCHLON 842LM, and SUPERCHLON 851L, hereinabove manufactured by NIPPON PAPER INDUSTRIES CO., LTD.; X-10065, X-10088, X-10082, X-10087, X-10053, and X-10052, hereinabove manufactured by Baker Hughes, and the like.

The number-average molecular weight of the raw materials for a dispersible group is preferably 500 or more, more preferably 700 or more, and even more preferably 900 or more, from the viewpoint of dispersibility of the toner particles, and the number-average molecular weight is preferably 5,000 or less, more preferably 4,000 or less, and even more preferably 3,000 or less, from the viewpoint of adsorbability of the dispersant to the toner particles.

The melting point of the raw materials for a dispersible group is preferably 60° C. or higher, more preferably 70° C. or higher, and even more preferably 80° C. or higher, from the viewpoint of elevating a melting point of the dispersant, and the melting point is preferably 160° C. or lower, more preferably 150° C. or lower, and even more preferably 140° C. or lower, from the viewpoint of dispersibility of the toner particles.

The melting point of the basic dispersant is preferably 34° C. or higher, more preferably 50° C. or higher, and even more preferably 65° C. or higher, from the viewpoint of elevating a melting point of the dispersant, and the melting point is preferably 150° C. or lower, more preferably 140° C. or lower, and even more preferably 130° C. or lower, from the viewpoint of dispersibility of the toner particles.

The dispersant other than the basic dispersant may be used, and the dispersant other than the basic dispersant includes copolymers of alkyl methacrylate/amino group-containing methacrylate, copolymers of α-olefin/vinyl pyrrolidone (Antaron V-216), and the like.

The amount of the basic dispersant used in the step I, based on 100 parts by mass of a total amount of the resin binder and the colorant, is preferably 0.1 parts by mass or more, more preferably 1 part by mass or more, and even more preferably 2 parts by mass or more, from the viewpoint of dispersibility of the toner particles, and the amount used is preferably 20 parts by mass or less, more preferably 15 parts by mass or less, and even more preferably 10 parts by mass or less, from the viewpoint of chargeability of the toner particles.

The stirring temperature in the step I is a temperature equal to or higher than a glass temperature Tg of the resin binder, preferably equal to or higher than a temperature calculated as Tg plus 10° C. (+10° C.), and more preferably equal to or higher than a temperature calculated as Tg+20° C., from the viewpoint of miscibility of the toner raw materials, and the stirring temperature is preferably equal to or lower than a temperature calculated as Tg plus 150° C. (+150° C.), more preferably equal to or lower than a temperature calculated as Tg+125° C., and even more preferably equal to or lower than a temperature calculated as Tg+100° C., from the viewpoint of interactions of the resin binder and the dispersant. In the present invention, when the resin binder is composed of plural resins, a weighted average of glass transition temperatures of each of the resins is defined as a glass transition temperature of the resin binder.

The stirring time in the step I is not particularly limited so long as the toner raw materials are stirred to an extent of being homogenously mixed, and the stirring time is preferably 0.5 minutes or more, more preferably 5 minutes or more, and even more preferably 30 minutes or more, and preferably 180 minutes or less, more preferably 150 minutes or less, and even more preferably 120 minutes or less.

The stirring means and the stirring rate are not particularly limited so long as the method allows to stir the entire raw materials. Among them, in the step I, it is preferable that the stirring is carried out with a mixer in which an axis of revolution is connected with two or more axes of rotations, and agitation blades arranged on each of the axes of rotation perform planetary movements (hereinafter referred to as a planetary mixer), a paddle-shaped agitators, a kneader-type mixer, or the like, from the viewpoint of dispersibility of the colorant and the dispersant and formation of smaller particle sizes of the toners.

Specifically, in the step I, since the mixing (or kneading) is carried out in a state that a solid content concentration is high, the viscosities of the mixture (or the kneaded mixture) vary in a wide range depending upon the state of mixing (or kneading). Since the mixture has a highly viscous state, especially in the step I, the stirring may be insufficient or uneven in some cases. As a result, dispersion and phase inversion emulsification of the colorant and the dispersant may not be sufficiently carried out in some cases. From the above viewpoint, as a mixer, those mentioned above are preferably used, and a planetary mixer is preferred, from the viewpoint of meeting a wide range of viscosities from low to high.

The planetary mixer allows to stir and mix (or knead) a mixture in an agitation vessel using agitation blades each having two axes of rotations and revolution, and the planetary mixer has a structure in which a dead space in the agitation vessel can be reduced, whereby homogeneous mixing (or kneading) can be obtained. In addition, a high load can be applied by having a shape of the blades that is thick. Further, the mixing (or the kneading) can be performed in a wide range from high load to low load, and all the states of from those having high viscosities to low viscosities during mixing can be performed in the same agitation vessel.

Figure 2:
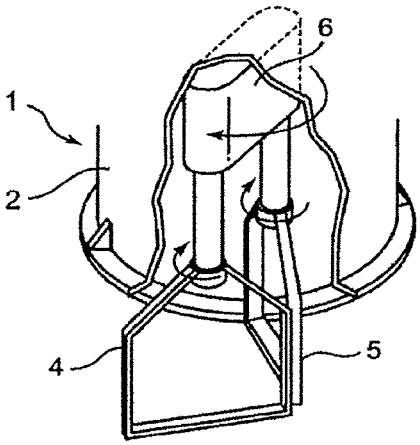
FIG. 2 A partial enlarged view of one example of a planetary mixer.

One example of a planetary mixer usable in the present invention is shown in FIG. 1, and a partial enlarged view including agitation blades thereof is shown in FIG. 2.

In the figures, the numeral 1 is an agitation vessel, wherein the agitation vessel 1 comprises an upper member 2 and a lower member 3, and wherein in the internal of the upper member 2, for example, agitation blades 4, 5 made of frame blades are held in one rotor 6. When the rotor 6 rotates (revolves), the agitation blades 4, 5 rotates (rotates) unidirectionally. Moreover, two agitation blades 4, 5 each performs so-called sun-and-moon movements (planetary movements) of rotating movements together with the revolving movement of the rotor 6.

In the planetary mixer, a strong shearing force acts between the agitation blades 4, 5 and between these agitation blades and an internal side of the agitation vessel 1 due to the planetary movements of the agitation blades 4, 5 described above, whereby high levels of stirring, kneading and dispersing actions are obtained. When a dispersion is mixed while heating to a given temperature, the resin becomes viscous, so that a large load is applied to the rotations of the agitation blades 4, 5 by mixing the resin with a colorant or a dispersant. At this time, a large shearing force is applied to the materials between the agitation blades 4, 5 and between these agitation blades 4, 5 and the agitation vessel 1, so that the colorant and the dispersant are sufficiently dispersed and mixed in the resin. Further, homogeneous and efficient mixing can be performed by allowing the agitation blades arranged on the axis of rotations to perform planetary movements. Moreover, by especially using a kneader such as a planetary mixer, efficient mixing (kneading) can be carried out by mild agitations without performing strong agitations, so that a resin, a colorant, a dispersant and the like are nearly sufficiently mixed.

Figure 3:
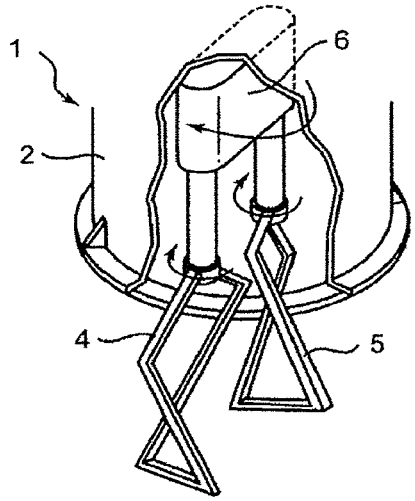
FIG. 3 A partial enlarged view of another example of a planetary mixer.

In the present invention, as at least one agitation blades arranged on the above axis of rotations, one having a torsional shape in an opposite direction to the rotation is preferably used. Here, the term "torsional shape" is not particularly limited so long as it is a shape in which a torsion in an opposite direction to the rotation of a flat blade is applied to the flat blade as shown in FIG. 2 so that the movements of holding the mixture in a downward direction are added to convect the mixture up and down. Specifically, the torsional shape refers to a shape that is torsional with a certain angle to a plane parallel to the axis of rotation including the above flat blade, in an opposite direction to the rotation. FIG. 3 is an enlarged view showing one example of agitation blades of a torsional shape in a direction opposite to the direction of the rotation. By having the structure mentioned above, the movements of holding the mixture in the downward movement are added, and the mixture is convected up and down so that further homogeneous mixing (kneading) is made possible.

The degree of the above torsion is not particularly limited, and can be properly adjusted depending upon the desired degree of agitations. It is preferable that the degree is adjusted so that even more homogeneous mixing (kneading) is made possible. Specifically, for example, in a case where the agitation blades are frame blades, it is preferable that an angle of torsion formed between a plane parallel to axis of rotations including a flat blade without torsion and a blade tip end of the torsional shape is, for example, from 10° to 90°, and more preferably from 30° to 80°, from the viewpoint of improving miscibility. The shapes and the sizes of the agitation blades arranged on the above axis of rotations are not particularly limited, and can be properly selected from those that are ordinarily used so that the intended stirring is obtained.

The agitation peripheral speed of the agitation blades arranged on the axis of rotations of the mixer is preferably from 0.4 to 5 m/sec, and more preferably from 0.4 to 4 m/sec, from the viewpoint of dispersibility of the resin and the colorant for the agitation blades arranged on the axes of rotation, and especially the performance of the toner obtainable by the method of the present invention. Two or more agitation blades may have the same or different peripheral speeds.

The paddle-shaped agitator which can be used in the present invention is not particularly limited, and any one of those that are generally used can be used. The agitation peripheral speed is preferably 0.5 m/sec or more, and more preferably from 0.5 to 3 m/sec, from the viewpoint of dispersibility of the resin and the colorant.

In the stirring of the step I, the insulating liquid explained in the step II may be present. This insulating liquid may be identical to or different from an insulating liquid used in the step II.

The amount of the insulating liquid used in the step I, based on 100 parts by mass of a total amount of the resin binder and the colorant, is preferably 1 part by mass or more, more preferably 5 parts by mass or more, and even more preferably 10 parts by mass or more, from the viewpoint of miscibility of the toner raw materials, and the amount used is preferably 100 parts by mass or less, more preferably 80 parts by mass or less, and even more preferably 50 parts by mass or less, from the viewpoint of formation of phase inversion emulsification of the toner.

The content of the resin binder in the stirred mixture in the step I is preferably 50% by mass or more, more preferably 60% by mass or more, and even more preferably 70% by mass or more, from the viewpoint of formation of phase inversion emulsification of the toner, and the content is preferably 99% by mass or less, more preferably 95% by mass or less, and even more preferably 90% by mass or less, from the viewpoint of miscibility of the toner raw materials.

In the step I, the resin binder, the colorant, and the basic dispersant may be mixed at one time and stirred at a temperature equal to or higher than a glass transition temperature of the resin binder, or a part of these raw materials may be previously mixed, and then mixed with the remaining raw materials and stirred at a temperature equal to or higher than a glass transition temperature of the resin binder. In the present invention, it is preferable that coarse toner particles (precursor of toner particles) are previously prepared, and then stirring is carried out, and it is preferable that the step I takes the following First Embodiment or Second Embodiment, from the viewpoint of dispersibility of the colorant in the toner particles.

First Embodiment is an embodiment including the step I that includes:

step I-1: preparing a precursor of toner particles containing the resin binder and the colorant; and step I-2: stirring a mixture containing the precursor of toner particles obtained in the step I-1 and the basic dispersant at a temperature of equal to or higher than a glass transition temperature of the resin binder.

Second Embodiment is an embodiment including the step I that includes:

step I-3: preparing a precursor of toner particles containing the resin binder, the colorant, and the basic dispersant; and step I-4: stirring a mixture containing the precursor of toner particles obtained in the step I-3 at a temperature of equal to or higher than a glass transition temperature of the resin binder.

In the step I-1 and the step I-3, it is preferable that the precursor of toner particles is prepared by a method including melt-kneading raw materials containing a resin binder and a colorant or raw materials containing a resin binder, a colorant, and a basic dispersant, and pulverizing a melt-kneaded mixture.

It is preferable that a resin binder, a colorant, and the like are previously mixed with a mixer such as a Henschel mixer, a Super mixer or a ball-mill, and the mixture is then fed to a kneader, and the Henschel mixer is more preferred, from the viewpoint of improving dispersibility of the colorant or the like in the resin binder.

The mixing with a Henschel mixer is carried out while adjusting the peripheral speed of agitation and the stirring time. The peripheral speed is preferably 10 in/sec or more and 30 msec or less, from the viewpoint of improving dispersibility of the colorant or the like. In addition, the stirring time is preferably 1 minute or more and 10 minutes or less, from the viewpoint of improving dispersibility of the colorant or the like.

The melt-kneading can be carried out with a known kneader, such as a tightly closed kneader, a single-screw or twin-screw kneader, or a continuous open-roller type kneader. In the method for production of the present invention, an open-roller type kneader is preferred, from the viewpoint of improving dispersibility of the colorant or the like, and from the viewpoint of improving an yield of the toner particles after pulverization.

The open-roller type kneader refers to a kneader of which melt-kneading unit is an open type, not being tightly closed, which can easily dissipate the kneading heat generated during the melt-kneading. The open-roller type kneader used in the present invention is provided with a plurality of feeding ports for raw materials and a discharging port for a kneaded mixture along the shaft direction of the roller, and it is preferable that the open-roller type kneader is a continuous open-roller type kneader, from the viewpoint of production efficiency.

It is preferable that the open-roller type kneader comprises at least two kneading rollers having different temperatures.

It is preferable that the setting temperatures of the rollers are such that the set temperature is equal to or lower than a temperature that is 10° C. higher than the softening point of the resin, from the viewpoint of improving miscibility of the toner raw materials.

In addition, it is preferable that the set temperature of the roller at an upstream side is higher than the set temperature of the roller at a downstream side, from the viewpoint of making the adhesiveness of the kneaded mixture to the roller at an upstream side favorable and strongly kneading at a downstream side.

It is preferable that the rollers have peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. The peripheral speed of the low-rotation roller is preferably 2 m/min or more, and more preferably 4 m/min or more, and preferably 100 m/min or less, more preferably 60 m/min or less, and even more preferably 50 m/min or less. Also, the ratio of the peripheral speeds of the two rollers, i.e. low-rotation roller/high-rotation roller, is preferably 1/10 or more, and more preferably 3/10 or more, and preferably 9/10 or less, and more preferably 8/10 or less.

In addition, structures, size, materials and the like of each of the rollers are not particularly limited. The surface of the roller comprises a groove used in kneading, and the shapes of grooves include linear, spiral, wavy, rugged or other forms.

Next, the melt-kneaded mixture is cooled to an extent that is pulverizable, and the cooled mixture is pulverized and optionally classified, whereby the toner particles can be obtained.

The pulverization may be carried out in divided multi-stages. For example, the melt-kneaded mixture may be roughly pulverized to a size of from 1 to 5 mm or so, and the roughly pulverized product may then be further finely pulverized.

The volume-median particle size $D_{50}$ of the precursor of the toner particles obtained in the step I-1 or the step I-3 is preferably 0.1 mm or more, and more preferably 0.5 mm or more, and preferably 15 mm or less, and more preferably 10 mm or less, from the viewpoint of improving productivity of the precursor of the toner particles. Here, the volume-median particle size $D_{50}$ means a particle size of which cumulative volume frequency calculated on a volume percentage is 50% counted from the smaller particle sizes.

The stirring in the step I-2 and the step I-4 are as mentioned above.

The step II is a step of adding dropwise from 50 to 500 parts by mass of the insulating liquid to a stirred mixture of the step I, based on 100 parts by mass of the stirred mixture at a temperature of equal to or higher than a glass transition temperature of the resin binder, thereby carrying out a phase inversion emulsification, to provide a dispersion of toner particles. In the present invention, the phase inversion emulsification refers a state that the raw materials of toner particles which have been originally in a continuous phase are dispersed as toner particles in a dispersion medium in which an insulating liquid is a continuous phase. It is preferable that the step II is also carried out under stirring in the same manner as in the step I.

The insulating liquid in the present invention means a liquid through which electricity is less likely to flow, and in the present invention, the conductivity of the insulating liquid is preferably $1.0\times10^{-11}$ S/m or less, and more preferably $5.0\times10^{-12}$ S/m or less, and preferably $1.0\times10^{-13}$ S/m or more.

Specific examples of the insulating liquid include, for example, aliphatic hydrocarbons, alicyclic hydrocarbons, aromatic hydrocarbons, halogenated hydrocarbons, polysiloxanes, vegetable oils, and the like. Among them, the aliphatic hydrocarbons such as liquid paraffin and isoparaffin are preferred, especially from the viewpoint of odor, harmlessness, and costs. Commercially available products of the aliphatic hydrocarbons include Isopar G, Isopar H, Isopar L, Isopar K, hereinabove manufactured by Exxon Mobile Corporation; ShellSol 71, manufactured by Shell Chemicals Japan Ltd.; IP Solvent 1620, IP Solvent 2080, hereinabove manufactured by Idemitsu Kosan Co., Ltd.; MORESCO WHITE P-55, MORESCO WHITE P-70, MORESCO WHITE P-100, MORESCO WHITE P-150, MORESCO WHITE P-260, hereinabove manufactured by MATSUMURA OIL Co., Ltd.; Cosmo White P-60, Cosmo White P-70, hereinabove manufactured by COSMO OIL LUBRICANTS, CO., LTD.: Lytol manufactured by Sonneborn; and the like. One or more members of these insulation liquids can be used in combination.

The viscosity of the insulating liquid at 25° C. is preferably 0.5 mPa·s or more, and more preferably 1 mPa·s or more, and preferably 100 mPa·s or less, more preferably 50 mPa·s or less, and even more preferably 30 mPa·s or less, from the viewpoint of improving developing ability, and from the viewpoint of improving storage stability of the toner particles in the liquid developer.

In addition, the amount of the insulating liquid used which is dropped in the step II, based on 100 parts by mass of the stirred mixture of the step I, is 50 parts by mass or more, preferably 80 parts by mass or more, and more preferably 100 parts by mass or more, from the viewpoint of stability of the toner particles, and the amount used is 500 parts by mass or less, preferably 400 parts by mass or less, and more preferably 300 parts by mass or less, from the viewpoint of high solid content formation of the toner particles.

In addition, the amount of the insulating liquid used which is dropped in the step II is such that it is preferable that the solid content concentration of the liquid developer after dropping is adjusted to an amount of preferably 10% by mass or more, more preferably 15% by mass or more, and even more preferably 20% by mass or more, and preferably 50% by mass or less, more preferably 45% by mass or less, and even more preferably 40% by mass or less. After the step II, the solid content concentration of the liquid developer may be adjusted by further diluting with the insulating liquid.

The dropping temperature in the step II is a temperature equal to or higher than a glass transition temperature Tg of the resin binder, preferably a temperature equal to or higher than a temperature calculated as Tg plus 10° C. (+10° C.), and more preferably a temperature equal to or higher than a temperature calculated as Tg+20° C., from the viewpoint of miscibility of the raw materials for the toner particles and the insulating liquid, and the dropping temperature is preferably a temperature equal to or lower than a temperature calculated as Tg+150° C., more preferably a temperature equal to or lower than a temperature calculated as Tg+125° C., and even more preferably a temperature equal to or lower than a temperature calculated as Tg+100° C., from the viewpoint of interactions between the resin binder and the dispersant. Here, the dropping temperature is defined as a temperature of a stirred mixture to which an insulating liquid is added dropwise.

The stirring temperature in the step I and the dropping temperature in the step II may be the same or different.

It is more preferable that the dropping of the insulating liquid in the step II is a method including dropping an insulating liquid, while further stirring the stirred mixture of the step I.

The dropping rate of the insulating liquid in the step II, per 100 g of the stirred mixture of the step I, is preferably 0.1 g/min or more, more preferably 0.5 g/min or more, even more preferably 1 g/min or more, and even more preferably 5 g/min or more, from the viewpoint of productivity, and the dropping rate is preferably 100 g/min or less, more preferably 50 g/min or less, and even more preferably 30 g/min or less, from the viewpoint of obtaining homogeneous toner particles.

Alternatively, the method of the present invention may be a method including:

step i: stirring raw materials containing the resin binder and the basic dispersant at a temperature of equal to or higher than a glass transition temperature of the resin binder;

step ii: adding dropwise the insulating liquid to a stirred mixture of the step i at a temperature of equal to or higher than a glass transition temperature of the resin binder, thereby carrying out a phase inversion emulsification, to provide a dispersion of toner particles; and step iii: mixing the dispersion obtained in the step ii with the colorant.

The step i can be carried out in the same manner as in the step i mentioned above. However, since a colorant is not used, a resin binder and a dispersant, and further preferably an insulating liquid are mixed and stirred, without previously preparing a precursor of toner particles. The amount of the insulating liquid used in the step i, based on 100 parts by mass of the resin binder, is preferably 1 part by mass or more, more preferably 5 parts by mass or more, and even more preferably 10 parts by mass or more, and from the viewpoint of formation of phase inversion emulsification of the toner, the amount used is preferably 100 parts by mass or less, more preferably 80 parts by mass or less, and even more preferably 50 parts by mass or less.

The step ii can be carried out in the same manner as in the step II mentioned above.

The amount of the colorant used in the step iii, based on 100 parts by mass of the toner particles in the dispersion, is preferably 5 parts by mass or more, and more preferably 10 parts by mass or more, and preferably 100 parts by mass or less, and more preferably 80 parts by mass or less.

A mixing means of the step iii is not particularly limited.

The liquid developer obtainable by the method of the present invention may properly contain, in addition to the resin binder, the colorant, the basic dispersant, and the insulating liquid, an additive such as a releasing agent, a charge control agent, a charge control resin, a magnetic particulate, a fluidity improver, an electric conductivity modifier, a reinforcing filler such as a fibrous material, an antioxidant, or a cleanability improver.

The solid content concentration of the liquid developer is preferably 10% by mass or more, more preferably 15% by mass or more, and even more preferably 20% by mass or more, from the viewpoint of improving the optical density, and the solid content concentration is preferably 50% by mass or less, more preferably 45% by mass or less, and even more preferably 40% by mass or less, and even more preferably 30% by mass or less, from the viewpoint of improving dispersion stability of the toner particles, thereby improving storage stability.

The volume-median particle size $D_{50}$ of the toner particles in the liquid developer is preferably 0.1 μM or more, more preferably 0.5 μm or more, and even more preferably 1.0 μm or more, from the viewpoint of reducing viscosity of the liquid developer, and the volume-median particle size is preferably 5 μm or less, more preferably 4 μm or less, and even more preferably 3 μm or less, from the viewpoint of improving image quality of the liquid developer.

The viscosity of the liquid developer, the solid content concentration of which is 25% by mass, at 25° C. is preferably 0.5 mPa·s or more, more preferably 1 mPa·s or more, and even more preferably 2 mPa·s or more, from the viewpoint of improving dispersion stability of the toner particles, thereby improving storage stability, and the viscosity is preferably 50 mPa·s or less, more preferably 40 mPa·s or less, and even more preferably 30 mPa·s or less, from the viewpoint of improving fusing ability of the liquid developer.

With regard to the embodiments described above, the present invention further discloses the following methods for producing a liquid developer.

<1> A method for producing a liquid developer containing a resin binder containing a resin having an acidic group, a colorant, a basic dispersant, and an insulating liquid, including:

step I: stirring raw materials containing the resin binder, the colorant, and the basic dispersant at a temperature of equal to or higher than a glass transition temperature of the resin binder; and step II: adding dropwise from 50 to 500 parts by mass of the insulating liquid to a stirred mixture of the step I, based on 100 parts by mass of the stirred mixture at a temperature of equal to or higher than a glass transition temperature of the resin binder, thereby carrying out a phase inversion emulsification, to provide a dispersion of toner particles.

<2> The method according to the above <1>, wherein the resin having an acidic group contains a polyester-based resin, wherein the polyester-based resin is a polyester resin or a composite resin containing a polyester resin and a styrenic resin.

<3> The method according to the above <1> or <2>, wherein the acid value of the resin having an acidic group is 3 mgKOH/g or more, preferably 5 mgKOH/g or more, and more preferably 8 mgKOH/g or more, and 60 mgKOH/g or less, preferably 50 mgKOH/g or less, more preferably 40 mgKOH/g or less, and even more preferably 30 mgKOH/g or less.

<4> The method according to any one of the above <1> to <3>, wherein the basic dispersant contains a basic dispersant having an amino group and/or an imino group.

<5> The method according to any one of the above <1> to <4>, wherein the basic dispersant contains at least one group derived from one member selected from the group consisting of a hydrocarbon having 16 or more carbon atoms, a hydrocarbon having 16 or more carbon atoms partly substituted with a halogen atom, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms, and a polyolefin.

<6> The method according to any one of the above <1> to <5>, wherein the basic dispersant has a polyolefin unit, preferably a polypropylene unit and/or a polyisobutene unit, and more preferably a polypropylene unit.

<7> The method according to any one of the above <1> to <6>, wherein the basic dispersant is a reaction product of raw materials for a basic nitrogen-containing group and raw materials for a dispersible group.

<8> The method according to the above <7>, wherein the raw materials for a basic nitrogen-containing group are at least one member selected from the group consisting of polyalkyleneimines, polyallylamines, and polyaminoalkyl methacrylates.

<9> The method according to the above <7> or <8>, wherein the number-average molecular weight of the raw materials for a basic nitrogen-containing group is 100 or more, preferably 500 or more, and more preferably 1,000 or more, and 15,000 or less, preferably 10,000 or less, and more preferably 5,000 or less.

<10> The method according to any one of the above <7> to <9>, wherein the raw materials for a dispersible group is at least one member selected from the group consisting of a halogenated hydrocarbon having 16 or more carbon atoms, a hydrocarbon having 16 or more carbon atoms having a reactive functional group, a polymer of a hydroxycarboxylic acid having 16 or more carbon atoms, a polymer obtained from a dibasic acid having 2 or more carbon atoms and 22 or less carbon atoms and a diol having 2 or more carbon atoms and 22 or less carbon atoms, a polymer of an alkyl (meth)acrylate having 16 or more carbon atoms having a reactive functional group, and a polyolefin having a reactive functional group.

<11> The method according to any one of the above <7> to <10>, wherein the number-average molecular weight of the raw materials for a dispersible group is 500 or more, preferably 700 or more, and more preferably 900 or more, and 5,000 or less, preferably 4,000 or less, and more preferably 3,000 or less.

<12> The method according to any one of the above <1> to <11>, wherein the step I includes:

step I-1: preparing a precursor of toner particles containing the resin binder and the colorant; and step I-2: stirring a mixture containing the precursor of toner particles obtained in the step I-1 and the basic dispersant at a temperature of equal to or higher than a glass transition temperature of the resin binder.

<13> The method according to any one of the above <1> to <11>, wherein the step I includes:

step I-3: preparing a precursor of toner particles containing the resin binder, the colorant, and the basic dispersant; and step I-4: stirring a mixture containing the precursor of toner particles obtained in the step I-3 at a temperature of equal to or higher than a glass transition temperature of the resin binder.

<14> A method for producing a liquid developer containing a resin binder containing a resin having an acidic group, a colorant, a basic dispersant, and an insulating liquid, including:

step i: stirring raw materials containing the resin binder and the basic dispersant at a temperature of equal to or higher than a glass transition temperature of the resin binder;

step ii: adding dropwise from 50 to 500 parts by mass of the insulating liquid to a stirred mixture of the step i, based on 100 parts by mass of the stirred mixture at a temperature of equal to or higher than a glass transition temperature of the resin binder, thereby carrying out a phase inversion emulsification, to provide a dispersion of toner particles; and step iii: mixing the dispersion obtained in the step ii with the colorant.

<15> The method according to any one of the above <1> to <14>, wherein the stirring temperature in the step I or the step i is a temperature equal to or higher than a glass temperature Tg of the resin binder, preferably equal to or higher than a temperature calculated as Tg plus 10° C. (+10° C.), and more preferably equal to or higher than a temperature calculated as Tg+20° C., and preferably equal to or lower than a temperature calculated as Tg+150° C., more preferably equal to or lower than a temperature calculated as Tg+125° C., and even more preferably equal to or lower than a temperature calculated as Tg+100° C.

<16> The method according to any one of the above <1> to <15>, wherein the stirring time in the step I or the step i is 0.5 minutes or more, preferably 5 minutes or more, and more preferably 30 minutes or more, and 180 minutes or less, preferably 150 minutes or less, and more preferably 120 minutes or less.

<17> The method according to any one of the above <1> to <16>, wherein the content of the resin binder in the stirred mixture of the step I or the step i is 50% by mass or more.

<18> The method according to any one of the above <1> to <17>, wherein the dropping temperature in the step II or the step ii is a temperature equal to or higher than a glass transition temperature Tg of the resin binder, preferably equal to higher than a temperature calculated as Tg+10° C., and more preferably equal to or higher than a temperature calculated as Tg+20° C., and a temperature equal to or lower than a temperature calculated as Tg+150° C., preferably equal to or lower than a temperature calculated as Tg+125° C., and more preferably equal to or lower than a temperature calculated as Tg+100° C.

<19> The method according to any one of the above <1> to <18>, wherein the dropping rate of the insulating liquid in the step II or the step ii, per 100 g of the stirred mixture of the step I or the step i, is 0.1 g/min or more, preferably 0.5 g/min or more, more preferably 1 g/min or more, and even more preferably 5 g/min or more, and 100 g/min or less, preferably 50 g/min or less, and more preferably 30 g/min or less.

<20> The method according to any one of the above <1> to <19>, wherein the viscosity of the liquid developer, a solid content concentration of which is 25% by mass, at 25° C. is 0.5 mPa·s or more, preferably 1 mPa·s or more, and more preferably 2 mPa·s or more, and 50 mPa·s or less, preferably 40 mPa·s or less, and more preferably 30 mPa·s or less.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "Q20," manufactured by TA Instruments, a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Number-Average Molecular Weight (Mn) of Raw Materials for Basic Nitrogen-Containing Group]

The number-average molecular weight is obtained by measuring a molecular weight distribution in accordance with a gel permeation chromatography (GPC) method as shown hereinbelow.

(1) Preparation of Sample Solution

A sample is dissolved in a solution prepared by dissolving $Na_2SO_4$ in an aqueous 1% acetic acid solution at 0.15 mol/L so as to have a concentration of 0.2 g/100 mL. Next, this solution is filtered with a fluororesin filter "FP-200," manufactured by Sumitomo Electric Industries, Ltd., having a pore size of 0.2 μm, to remove insoluble components, to provide a sample solution.

(2) Molecular Weight Measurements

Using the following measurement apparatus and analyzing column, the measurement is taken by allowing a solution prepared by dissolving $Na_2SO_4$ in an aqueous 1% acetic acid solution at 0.15 mol/L to flow through a column as an eluent at a flow rate of 1 mL per minute, stabilizing the column in a thermostat at 40° C., and loading 100 μL of a sample solution thereto. The molecular weight of the sample is calculated based on the previously drawn calibration curve. At this time, a calibration curve which is drawn from several kinds of standard pullulans, manufactured by SHOWA DENKO CORPORATION, P-5 (Mw $5.9\times10^3$), P-50 (Mw $4.73\times10^4$), P-200 (Mw $2.12\times10^5$), and P-800 (Mw $7.08\times10^5$) as standard samples is used. The values within the parentheses show molecular weights.

Measurement Apparatus: HLC-8320GPC, manufactured by Tosoh Corporation

Analyzing Column; α+α-M+α-M, manufactured by Tosoh Corporation.

[Number-Average Molecular Weight (Mn) of Raw Materials for Dispersible Group]

(1) Preparation of Sample Solution

Raw materials for a dispersible group were dissolved in tetrahydrofuran so as to have a concentration of 0.5 g/100 mL. Next, this solution was filtered with a fluororesin filter "FP-200," manufactured by Sumitomo Electric Industries, Ltd., having a pore size of 2 μm, to remove insoluble components, to provide a sample solution.

(2) Measurement of Molecular Weight Distribution

Using the following measurement apparatus and analyzing column, the measurement is taken by allowing tetrahydrofuran to flow through a column as an eluent at a flow rate of 1 mL per minute, and stabilizing the column in a thermostat at 40° C., and loading 100 μL of a sample solution. The molecular weight of the sample is calculated based on the previously drawn calibration curve. At this time, a calibration curve is drawn from several kinds of monodisperse polystyrenes, manufactured by Tosoh Corporation, A-500 (Mw $5.0\times10^2$), A-1000 (Mw $1.01\times10^3$), A-2500 (Mw $2.63\times10^3$), A-5000 (Mw $5.97\times10^3$), F-1 (Mw $1.02\times10^4$), F-2 (Mw $1.81\times10^4$), F-4 (Mw $3.97\times10^4$), F-10 (Mw $9.64\times10^4$), F-20 (Mw $1.90\times10^5$), F-40 (Mw $4.27\times10^5$), F-80 (Mw $7.06\times10^5$), and F-128 (Mw $1.09\times10^6$) as standard samples. The values within parentheses show molecular weights.

Measurement Apparatus: HLC-8220GPC, manufactured by Tosoh Corporation

Analyzing Column: GMHXL+G3000HXL, manufactured by Tosoh Corporation.

[Melting Points of Raw Materials for Dispersible Group and Dispersant]

Using a differential scanning calorimeter "Q20," manufactured by TA Instruments, a 0.01 to 0.02 g sample is weighed out in an aluminum pan, and cooled from room temperature to −50° C. at a cooling rate of 10° C./min. Next, the temperature of the sample is raised from −50° to 200° C. at a heating rate of 10° C./min to measure endothermic peaks. The top of the peak of the endothermic peak is defined as a melting point.

[Volume-Median Particle Size of Precursor of Toner Particles]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in an insulating liquid, taking 20 measurements for conductivity at 25° C. with a non-aqueous conductivity meter "DT-700," manufactured by Dispersion Technology, Inc., and calculating an average thereof. The smaller the numerical figures, the higher the resistance.

[Viscosities at 25° C. of Insulating Liquid and Liquid Developer Solid Content Concentration of which is 25% by Mass]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Solid Content Concentrations of Liquid Developer]

Ten parts by mass of a sample is diluted with 90 parts by mass of hexane, and the dilution is rotated with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C.: 1 mPa·s, under conditions that a particle refractive index is 1.58, imaginary part being 0.1, and a dispersion medium refractive index is 1.42, at a concentration that gives a scattering intensity of from 5 to 15%.

Production Example 1 of Resin [Resin A]

A 10-L four-neck flask equipped with a nitrogen inlet tube, a dehydration tube, a stirrer, and a thermocouple was charged with raw material monomers, an esterification catalyst, and a polymerization inhibitor as listed in Table 1. The contents were reacted at 210° C., and reacted until a reaction percentage reached 90%. The reaction mixture was further reacted at 8.3 kPa, and the reaction was terminated at a point where a softening point reached an intended value, to provide a polyester resin having the physical properties as listed in Table 1. Here, in Production Example of Resins, the reaction percentage refers to a value calculated by:

[amount of generated water in reaction (mol)/theoretical amount of generated water (mol)]×100.

Production Example 2 of Resin [Resin B]

A 10-L four-neck flask equipped with a nitrogen inlet tube, a dehydration tube, a stirrer, and a thermocouple was charged with raw material monomers and an esterification catalyst as listed in Table 1. The contents were heated to 230° C. with a mantle heater, and reacted at 230° C. for 8 hours. Further, the reaction mixture was reacted at 8.3 kPa, and the reaction was carried out until a softening point as listed in Table 1 was reached, to provide a polyester resin having the physical properties as listed in Table 1.

TABLE 1

| | | Resin A | Resin B |
|---|---|---|---|
| Raw Material Monomers | BPA-PO[1)] | 7,437 g (100) | 2,493 g (35) |
| | BPA-EO[2)] | — | 4,299 g (65) |
| | Terephthalic Acid | — | 3,209 g (95) |
| | Fumaric Acid | 2, 563 g (104) | — |
| Esterification Catalyst | Tin(II) 2-Ethylhexanoate | 50 g | 50 g |
| Polymerization Inhibitor | 4-t-Butyl Catechol | 5 g | — |
| Physical Properties of Resin | Softening Point, ° C. | 101 | 112 |
| | Glass Transition Temperature, ° C. | 57 | 64 |
| | Acid Value, mgKOH/g | 19 | 5 |

Note)

The numerical figures inside the parentheses in the raw material monomers for a polyester resin are expressed by a molar ratio when a total number of moles of the alcohol component is defined as 100.

[1)]BPA-PO: Polyoxypropylene(2.2)-2,2-bis(4-hydroxyphenyl)propane

[2)]BPA-EO: Polyoxyethylene(2.0)-2,2-bis(4-hydroxyphenyl)propane

Production Example 1 of Dispersant [Dispersant A]

A 2 L four-neck flask equipped with a reflux condenser, a nitrogen inlet tube, a stirrer, a dehydration tube, and a thermocouple was charged with a polyethyleneimine, a polypropylene succinic anhydride (PPSA), and xylene manufactured by Wako Pure Chemical Industries, Ltd., and the internal of the reaction vessel was replaced with nitrogen gas. Thereafter, the internal of the reaction vessel was heated to 150° C., and the temperature was held thereat for one hour. Thereafter, the internal was heated to 160° C., and the temperature was held thereat for one hour. The pressure was reduced to 8.3 kPa at 160° C. to distill off the solvent. The time point at which a peak of acid anhydride ascribed to PPSA (1,780 $cm^{-1}$) disappeared and a peak ascribed to imide bond (1,700 $cm^{-1}$) was generated according to the IR analysis was defined as a reaction end point, to provide a dispersant having physical properties shown in Table 2.

Production Example 2 of Dispersant [Dispersant B]

A 2 L four-neck flask equipped with a reflux condenser, a nitrogen inlet tube, a stirrer, a dehydration tube, and a thermocouple was charged with a polyethyleneimine, a polyisobutene succinic anhydride (PIBSA), and xylene Wako Pure Chemical Industries, Ltd., and the internal of the reaction vessel was replaced with nitrogen gas. Thereafter, the internal of the reaction vessel was heated to 150° C., and the temperature was held thereat for 1 hour. Thereafter, the internal was heated to 160° C., and the temperature was held thereat for one hour. Thereafter, the pressure was reduced to 8.3 kPa at 160° C. to distill off the solvent. The time point at which a peak of acid anhydride ascribed to PIBSA (1,780 $cm^{-1}$) disappeared and a peak ascribed to imide bond (1,700 $cm^{-1}$) was generated according to the IR analysis was defined as a reaction end point, to provide a dispersant having physical properties shown in Table 2.

TABLE 2

| | | Dispersant A | Dispersant B |
|---|---|---|---|
| Raw Materials for Adsorbing Group | Polyethyleneimine 1200 | 9 g | 20 g |
| | Number-Average Molecular Weight | 3,400 | 3,400 |
| Raw Materials for Dispersible Group | PPSA1000 | 59.9 g | — |
| | PIBSA1000 | — | 187 g |
| | Number-Average Molecular Weight | 1,000 | 1,100 |
| Solvent | Xylene | 68.9 g | 207 g |
| Physical Properties | Melting Point, ° C. | 97 | — |

Note)
Polyethyleneimine 1200: manufactured by JUNSEI CHEMICAL CO., LTD.
PPSA1000: X-10065, manufactured by Baker Hughes, melting point: 108° C.
PIBSA1000: OLOA15500, manufactured by Chevron Japan Limited Examples 1 to 4 and 6 to 8 and Comparative Examples 1 and 3 to 5

[Step I-1]

Eighty-five parts by mass of a resin binder as listed in Tables 3 to 5 and 15 parts by mass of a colorant "ECB-301" manufactured by DAINICHISEIKA COLOR & CHEMICALS MFG. CO., LTD., Phthalocyanine Blue 15:3, were previously mixed with a 20-L Henschel mixer for 3 minutes at a rotational speed of 1,500 r/min (peripheral speed 21.6 m/sec). Thereafter, the mixture was melt-kneaded under the conditions given below.

(Melt-Kneading Conditions)

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a rotational speed of a high-rotation roller (front roller) of 75 r/min (peripheral speed of 32.4 m/min), a rotational speed of a low-rotation roller (back roller) of 35 r/min (peripheral speed of 15.0 m/min), and a gap between the rollers at an end of the kneaded mixture supplying side of 0.1 mm. The temperatures of the heating medium and the cooling medium inside the rollers were as follows. The high-rotation roller had a temperature at the raw material supplying side of 90° C., and a temperature at the kneaded mixture-discharging side of 85° C., and the low-rotation roller had a temperature at the raw material supplying side of 35° C., and a temperature at the kneaded mixture-discharging side of 35° C. In addition, the feeding rate of the raw material mixture to the kneader was 10 kg/h, and the average residence time in the kneader was about 3 minutes.

The kneaded mixture obtained above was roll-cooled with a cooling roller, and the cooled product was roughly pulverized with a hammer-mill to a size of 1 mm or so, to provide a precursor of toner particles 1 having a volume-median particle size $D_{50}$ of 1 mm or so.

[Step I-2]

In a 1-L four-neck flask equipped with a dehydration tube, an agitator, and a thermocouple, 100 g of the precursor of toner particles 1, 10 g of a dispersant listed in Tables 3 to 5 (not used in Comparative Example 3), and an insulating liquid "Isopar L" shown in Tables 3 to 5 manufactured by Exxon Mobile Corporation (isoparaffin, conductivity: $6.2\times10^{-13}$ S/m, viscosity at 25° C.: 1 mPa·s) were mixed, and stirred at a temperature and time shown in Tables 3 to 5.

The stirring conditions by the paddle-shaped agitator are as follows.

Blade: Diameter=Φ 70 mm, rotational speed=300 r/min

Homo-mixer (Homomixer MARK II, Model 2.5, manufactured by PRIMIX Corporation)

Blade: Diameter=Φ 30 mm, rotational speed=10,000 r/min

Here, the peripheral speed, m/s, was obtained by the following formula.

$$\text{Peripheral speed (m/s)}=\text{Diameter (m)}\times\pi\times\text{Rotational Speed (r/min)}/60$$

[Step II]

The stirred mixture of the step 1 was adjusted to a dropping temperature shown in Tables 3 to 5, and an insulating liquid "Isopar L" was added dropwise under the conditions shown in Tables 3 to 5, while stirring under the same conditions as in the step I-4, to provide a dispersion of toner particles, a solid content concentration of which was 30% by mass.

The dispersion was cooled to room temperature (25° C.), and further diluted with the insulating liquid to adjust its solid content concentration to 25% by mass, to provide a liquid developer shown in Tables 3 to 5.

Here, in Examples 1 to 4 and 6 to 8 and Comparative Example 1, a dispersion of toner particles was obtained by carrying out phase inversion emulsification together with the dropwise addition of the insulating liquid. However, in Comparative Example 4, the amount of the insulating liquid dropped in the step II is small, the phase inversion emulsification did not take place, and a dispersion of toner particles was obtained by a so-called coacervation method. In addition, in Comparative Examples 3 and 5, a liquid mixture was solidified during the course of the dropwise addition of the insulating liquid, so that a liquid developer could not be obtained.

Example 5

[Step I-3]

Eighty-five parts by mass of a resin binder as listed in Table 3, 10 parts by mass of a dispersant, and 15 parts by mass of a colorant "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec). Thereafter, the mixture was melt-kneaded under the conditions given below.

(Melt-Kneading Conditions)

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a rotational speed of a high-rotation roller (front roller) of 75 r/min (peripheral speed of 32.4 m/min), a rotational speed of a low-rotation roller (back roller) of 35 r/min (peripheral speed of 15.0 m/min), and a gap between the rollers at an end of the kneaded mixture supplying side of 0.1 mm. The temperatures of the heating medium and the cooling medium inside the rollers were as follows. The high-rotation roller had a temperature at the raw material supplying side of 90° C., and a temperature at the kneaded mixture-discharging side of 85° C., and the low-rotation roller had a temperature at the raw material supplying side of 35° C., and a temperature at the kneaded mixture-discharging side of 35° C. In addition, the feeding rate of the raw material mixture to the above kneader was 10 kg/h, the average residence time in the above kneader was about 3 minutes, and the temperature of the kneaded mixture was 85° C.

The kneaded mixture obtained above was roll-cooled with a cooling roller, and the cooled product was roughly pulverized with a hammer-mill to a size of 1 mm or so, to provide a precursor of toner particles 2 having a volume-median particle size $D_{50}$ of 1 mm or so.

[Step I-4]

In a 1-L four-neck flask equipped with a dehydration tube, an agitator, and a thermocouple, 110 g of the precursor of toner particles 2 and the insulating liquid "Isopar L" shown in Table 3 were mixed, and the contents were stirred at a temperature and time shown in Table 3.

[Step II]

The stirred mixture of the step 1 was adjusted to a dropping temperature shown in Table 3, and the insulating liquid "Isopar L" was added dropwise under the conditions shown in Table 3, while stirring under the same conditions as in the step I-4, to carry out a phase inversion emulsification, to provide a dispersion of toner particles, a solid content concentration of which was 30% by mass.

The dispersion was cooled to room temperature (25° C.), and further diluted with the insulating liquid to adjust its solid content concentration to 25% by mass, to provide a liquid developer shown in Table 3.

Example 9

[Step i]

In a 1-L four-neck flask equipped with a dehydration tube, an agitator, and a thermocouple, 85 g of the resin A, 10 g of a dispersant listed in Table 4, and 20 g of an insulating liquid "Isopar L" manufactured by Exxon Mobile Corporation (isoparaffin, conductivity: $6.2\times10^{-13}$ S/m, viscosity at 25° C.: 1 mPa·s) were mixed, and the contents were stirred at a temperature and time shown in Table 4.

[Step ii]

The stirred mixture of the step i was adjusted to a dropping temperature shown in Table 4, and the insulating liquid "Isopar L" was added dropwise under the conditions shown in Table 4, while stirring under the same conditions as in the step i, to provide a dispersion of toner particles.

[Step iii]

To 352 parts by mass of a dispersion of toner particles obtained in the step ii was added 15 parts by mass of a colorant "ECB-301" manufactured by DAINICHISEIKA COLOR & CHEMICALS MFG. CO., LTD., Phthalocyanine Blue 15:3, and the contents were stirred with "T.K. ROBOMIX," manufactured by PRIMIX Corporation, under ice-cooling at a rotational speed of 10,000 r/min for 30 minutes, to provide a dispersion of toner particles, a solid content concentration of which was 30% by mass. The dispersion was cooled to room temperature (25° C.), and further diluted with the insulating liquid to adjust its solid content concentration to 25% by mass, to provide a liquid developer shown in Table 4.

Example 10

The same procedures as in Example 1 were carried out except that the agitator used in the steps I and II were changed from the paddle-shaped agitator to a planetary mixer, and the stirring temperature of the step I-2 and the dropping temperature of the step II were changed, to provide a liquid developer shown in Table 4.

The stirring conditions by the planetary mixer are as follows.

Planetary mixer (1-L Model HIVIS MIX 2P-1, manufactured by PRIMIX Corporation)

Revolution: Diameter=Φ 134 mm, rotational speed=100 r/min

Rotation: Diameter=Φ 71 mm, rotational speed=243 r/min (revolution and rotation being unidirectional)

The peripheral speed of the planetary mixer is an added value of the peripheral speeds of revolution and the peripheral speed of rotation.

Example 11

The same procedures as in Example 10 were carried out except that a resin binder was changed from the resin A to a resin B, to provide a liquid developer shown in Table 4.

Comparative Example 2

[Step I]

In a 1-L four-neck flask equipped with a dehydration tube, an agitator, and a thermocouple, 100 g of the precursor of toner particles 1 and 20 g of an insulating liquid "Isopar L" shown in Table 5 were mixed with a paddle-shaped agitator (peripheral speed: 1.1 m/s) at 120° C.

[Step II]

While stirring the mixture of the step I under the same conditions as in the step I at 120° C., a liquid mixture of 237 g of the insulating liquid "Isopar L" heated to 120° C. and 10 g of a dispersant A was added dropwise thereto, to carry out a phase inversion emulsification, to provide a dispersion of toner particles.

The dispersion was cooled to room temperature (25° C.), and further diluted with the insulating liquid to adjust its solid content concentration to 25% by mass, to provide a liquid developer shown in Table 5.

Comparative Example 6

In a 1-L beaker, 100 g of the precursor of toner particles 1, 10 g of a dispersant A listed in Table 5, and 257 g of an insulating liquid "Isopar L" shown in Table 5 manufactured by Exxon Mobile Corporation (isoparaffin, conductivity: $6.2\times10^{-13}$ S/m, viscosity at 25° C.: 1 mPa·s) were mixed, and stirred with the homo-mixer under conditions of 10,000 r/min at 120° C. for 1 minute, to provide a dispersion of toner particles, a solid content concentration of which was 30% by mass. The dispersion was cooled to room temperature (25° C.), and further diluted with the insulating liquid to adjust its solid content concentration to 25% by mass, to provide a liquid developer shown in Table 5.

Test Example 1—Low-Temperature Fusing Ability

A liquid developer was dropped on "POD Gloss Coated Paper" manufactured by Oji Paper Co., Ltd., and a thin film was produced with a wire bar, so that the mass on a dry basis was 1.2 g/m$^2$. Thereafter, the produced thin film was held in a thermostat at 80° C. for 10 seconds.

Subsequently, a fusing treatment was carried out at a fusing roller temperature of 80° C. and a fusing speed of 280 mm/sec, with a fuser taken out of "OKI MICROLINE 3010," manufactured by Oki Data Corporation.

Thereafter, the same fusing treatment as mentioned above was carried out while raising the fusing roller temperature up to 160° C. with an increment of 10° C., to provide fused images at each temperature.

The fused images obtained were adhered to a mending tape "Scotch Mending Tape 810," manufactured by 3M Japan, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated from a value obtained by [optical density after removal]/[optical density before removal]×100, to evaluate low-temperature fusing ability where a temperature at which a fusing ratio reaches 90% or more is defined as a lowest fusing temperature. The results are shown in Tables 3 to 5. The smaller the numerical value, the more excellent the low-temperature fusing ability.

Test Example 2—Dispersion Stability

A 20 mL glass sample vial "Vial with screw cap, No. 5," manufactured by Maruemu Corporation was charged with 10 g of a liquid developer, and then stored in a thermostat held at 50° C. for 48 hours. The volume-median particle sizes $D_{50}$ of the toner particles before and after the storage were determined, and the dispersion stability was evaluated from the value of a difference thereof, i.e. [$D_{50}$ After Storage−$D_{50}$ Before Storage]. The results are shown in Tables 3 to 5. The more the numerical values approximates 0, the more excellent the dispersion stability.

TABLE 3

| | | | Ex. 1 | Ex. 2 | Ex. 3 | Ex. 4 | Ex. 5 |
|---|---|---|---|---|---|---|---|
| Step I or Step i | Resin Binder | Kind | Resin A | Resin A | Resin A | Resin A | Resin A |
| | | Glass Transition Temp., ° C. | 57 | 57 | 57 | 57 | 57 |
| | | Amount Used, g | 85 | 85 | 85 | 85 | 85 |
| | Colorant | Amount Used, g | 15 | 15 | 15 | 15 | 15 |
| | Dispersant | Kind | Dispersant A | Dispersant B | Dispersant A | Dispersant A | Dispersant A |
| | | Amount Used, g | 10 | 10 | 10 | 10 | 10 |
| | Insulating Liquid | Amount Used, g | 20 | 20 | 0 | 100 | 20 |
| | Stirring Conditions | Agitator | Paddle-shaped | Paddle-shaped | Paddle-shaped | Paddle-shaped | Paddle-shaped |
| | | Peripheral Speed, m/s | 1.1 | 1.1 | 1.1 | 1.1 | 1.1 |
| | | Temperature, ° C. | 120 | 120 | 120 | 120 | 85 |
| | | Time, min | 30 | 30 | 30 | 30 | 3 |
| | Stirred Mixture | Total Amount, g | 130 | 130 | 110 | 210 | 130 |
| Step II or Step ii | Insulating Liquid | Amount Used, g | 237 | 237 | 257 | 157 | 237 |
| | | Amount Used, Based on100 Parts by Mass of the Stirred Mixture, Parts by Mass | 182 | 182 | 234 | 75 | 182 |
| | Dispersant | Amount Used, g | 0 | 0 | 0 | 0 | 0 |
| | Dropping Conditions | Temperature, ° C. | 120 | 120 | 120 | 120 | 120 |
| | | Rate, g/min | 10 | 10 | 10 | 10 | 10 |
| | | Rate per 100 g of the Stirred Mixture, g/min | 7.7 | 7.7 | 9.1 | 4.8 | 7.7 |
| Step iii | Dispersion | Amount Used, Parts by Mass | — | — | — | — | — |
| | Colorant | Amount Used, Parts by Mass | — | — | — | — | — |
| | Production Method | | Phase inversion emulsification | Phase inversion emulsification | Phase inversion emulsification | Phase inversion emulsification | Phase inversion emulsification |
| Liquid Developer | Physical Properties | $D_{50}$, μm | 1.7 | 2.4 | 2.2 | 2.8 | 2.0 |
| | | Viscosity, mPa · s | 2 | 3 | 2 | 2 | 3 |
| | Evaluation | Low-Temperature Fusing Ability, ° C. | 80 | 90 | 80 | 80 | 80 |
| | | Dispersion Stability: $D_{50}$ After Storage | 1.7 | 2.4 | 2.2 | 2.8 | 2.0 |
| | | Dispersion Stability: Change in Particle Sizes Before and After Storage | 0.0 | 0.0 | 0.0 | 0.0 | 0.0 |

TABLE 4

| | | | Ex. 6 | Ex. 7 | Ex. 8 | Ex. 9 | Ex. 10 | Ex. 11 |
|---|---|---|---|---|---|---|---|---|
| Step I or Step i | Resin Binder | Kind | Resin A | Resin A | Resin A | Resin A | Resin A | Resin B |
| | | Glass Transition Temp., ° C. | 57 | 57 | 57 | 57 | 57 | 64 |
| | | Amount Used, g | 85 | 85 | 85 | 85 | 85 | 85 |
| | Colorant | Amount Used, g | 15 | 15 | 15 | 0 | 15 | 15 |
| | Dispersant | Kind | Dispersant A | Dispersant A | Dispersant A | Dispersant A | Dispersant A | Dispersant A |
| | | Amount Used, g | 10 | 10 | 10 | 10 | 10 | 10 |
| | Insulating Liquid | Amount Used, g | 20 | 20 | 20 | 20 | 20 | 20 |
| | Stirring Conditions | Agitator | Paddle-shaped | Paddle-shaped | Paddle-shaped | Paddle-shaped | Planetary mixer | Planetary mixer |
| | | Peripheral Speed, m/s | 1.1 | 1.1 | 1.1 | 1.1 | 1.6 | 1.6 |
| | | Temperature, ° C. | 120 | 120 | 120 | 120 | 85 | 85 |
| | | Time, min | 180 | 30 | 30 | 30 | 30 | 30 |
| | Stirred Mixture | Total Amount, g | 130 | 130 | 130 | 115 | 130 | 130 |
| Step II or Step ii | Insulating Liquid | Amount Used, g | 237 | 237 | 237 | 237 | 237 | 237 |
| | | Amount Used, Based on100 Parts by Mass of the Stirred Mixture, Parts by Mass | 182 | 182 | 182 | 206 | 182 | 182 |
| | Dispersant | Amount Used, g | 0 | 0 | 0 | 0 | 0 | 0 |
| | Dropping Conditions | Temperature, ° C. | 120 | 120 | 120 | 120 | 85 | 85 |
| | | Rate, g/min | 10 | 1 | 80 | 10 | 10 | 10 |
| | | Rate per 100 g of the Stirred Mixture, g/min | 7.7 | 0.8 | 61.5 | 8.7 | 7.7 | 7.7 |
| Step iii | Dispersion | Amount Used, Parts by Mass | — | — | — | 352 | — | — |
| | Colorant | Amount Used, Parts by Mass | — | — | — | 15 | — | |
| | Production Method | | Phase inversion emulsification | Phase inversion emulsification | Phase inversion emulsification | Phase inversion emulsification | Phase inversion emulsification | Phase inversion emulsification |
| Liquid Developer | Physical Properties | $D_{50}$, μm | 1.5 | 1.6 | 3.5 | 1.3 | 0.5 | 0.4 |
| | | Viscosity, mPa · s | 3 | 3 | 3 | 3 | 2 | 3 |
| | Evaluation | Low-Temperature Fusing Ability, ° C. | 80 | 80 | 80 | 80 | 80 | 90 |
| | | Dispersion Stability: $D_{50}$ After Storage | 1.5 | 1.6 | 3.5 | 1.5 | 0.5 | 0.4 |
| | | Dispersion Stability: Change in Particle Sizes Before and After Storage | 0.0 | 0.0 | 0.0 | 0.2 | 0.0 | 0.0 |

TABLE 5

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Step I | Resin Binder | Kind | Resin A | Resin A | Resin A | Resin A | Resin A | Resin A |
| | | Glass Transition Temp., ° C. | 57 | 57 | 57 | 57 | 57 | 57 |
| | | Amount Used, g | 85 | 85 | 85 | 85 | 85 | 85 |
| | Colorant | Amount Used, g | 15 | 15 | 15 | 15 | 15 | 15 |
| | Dispersant | Kind | Dispersant A | — | — | Dispersant A | Dispersant A | Dispersant A |
| | | Amount Used, g | 10 | 0 | 0 | 10 | 10 | 10 |
| | Insulating Liquid | Amount Used, g | 20 | 20 | 20 | 200 | 20 | 257 |
| | Stirring Conditions | Agitator | Paddle-shaped | Paddle-shaped | Paddle-shaped | Paddle-shaped | Paddle-shaped | Homo-mixer |
| | | Peripheral Speed, m/s | 1.1 | 1.1 | 1.1 | 1.1 | 1.1 | 15.7 |
| | | Temperature, ° C. | 25 | — | 120 | 120 | 120 | 120 |
| | | Time, min | 30 | 0 | 30 | 30 | 30 | 1 |
| | Stirred Mixture | Total Amount, g | 130 | 120 | 120 | 310 | 130 | 367 |
| Step II | Insulating Liquid | Amount Used, g | 237 | 237 | 237 | 57 | 237 | — |
| | | Amount Used, Based on100 Parts by Mass of the Stirred Mixture, Parts by Mass | 182 | 198 | 198 | 18 | 182 | — |
| | Dispersant | Kind | — | Dispersant A | — | — | — | — |
| | | Amount Used, g | 0 | 10 | 0 | 0 | 0 | — |

TABLE 5-continued

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| | Dropping Conditions | Temperature, ° C. | 25 | 120 | 120 | 120 | 25 | — |
| | | Rate, g/min | 10 | 10 | 10 | 10 | 10 | — |
| | | Rate per 100 g of the Stirred Mixture, g/min | 7.7 | 8.3 | 8.3 | 3.2 | 7.7 | — |
| | Production Method | | Phase inversion emulsification | Phase inversion emulsification | Phase inversion emulsification | Coacervation | Phase inversion emulsification | Forced emulsification |
| Liquid Developer | Physical Properties Evaluation | $D_{50}$, μm | 11 | 240 | Solidified | 7 | Solidified | 20 |
| | | Viscosity, mPa · s | 3 | 5 | | 5 | | 5 |
| | | Low-Temperature Fusing Ability, ° C. | Unable to evaluate | Unable to evaluate | — | 120 | — | Unable to evaluate |
| | | Dispersion Stability: $D_{50}$ After Storage | Solidified | Solidified | — | 45 | — | Solidified |
| | | Dispersion Stability: Change in Particle Sizes Before and After Storage | — | — | — | 38.0 | — | — |

It can be seen from the above results that the liquid developers of Examples 1 to 11 have reduced viscosity and excellent low-temperature fusing ability and dispersion stability, and that the toner particles are smaller in particle sizes.

On the other hand, in Comparative Example 1 where the step I and the step II were carried out at a temperature lower than a glass transition temperature, toner particles having smaller particle sizes are not obtained. In addition, in Comparative Example 2 where a dispersant is used in the step II, toner particles having smaller particle sizes cannot be obtained and such tendencies are especially remarkable. In addition, in Comparative Example 3 without using a dispersant, a liquid developer is not obtained due to solidification of a liquid mixture. In addition, in Comparative Example 4 where a liquid developer is produced by a coacervation method, toner particles having smaller particle sizes are not obtained. In addition, in Comparative Example 5 where the step I is carried out at a temperature equal to or higher than a glass transition temperature but the step II is carried out at a temperature lower than the glass transition temperature, a liquid is not obtained due to solidification of a liquid mixture. In Comparative Example 6 where the step II is omitted because of the use of a homo-mixer, toner particles having smaller particle sizes are not obtained.

The liquid developer obtainable by the method of the present invention is suitably used in development or the like of latent images formed in, for example, electrophotography, electrostatic recording method, electrostatic printing method or the like.

EXPLANATION OF NUMERALS

1 an agitation vessel
2 an upper member of the agitation vessel
3 a lower member of the agitation vessel
4 an agitation blade
5 an agitation blade
6 a rotor

The invention claimed is:

1. A method for producing a liquid developer comprising a resin binder comprising a resin having an acidic group, a colorant, a basic dispersant, and an insulating liquid, comprising:

I: stirring raw materials comprising the resin binder, the colorant, and the basic dispersant at a temperature of equal to or higher than a glass transition temperature of the resin binder, to obtain a stirred mixture; and II: adding dropwise from 50 to 500 parts by mass of the insulating liquid to said stirred mixture, based on 100 parts by mass of said stirred mixture at a temperature of equal to or higher than a glass transition temperature of the resin binder, thereby carrying out a phase inversion emulsification, to obtain a dispersion of toner particles.

2. The method according to claim 1, wherein said I stirring comprises:

I-1: preparing a precursor of toner particles comprising the resin binder and the colorant; and I-2: stirring a mixture comprising said precursor of toner particles and the basic dispersant at a temperature of equal to or higher than a glass transition temperature of the resin binder.

3. The method according to claim 1, wherein said I stirring comprises:

I-3: preparing a precursor of toner particles comprising the resin binder, the colorant, and the basic dispersant; and I-4: stirring a mixture comprising said precursor of toner particles at a temperature of equal to or higher than a glass transition temperature of the resin binder.

4. The method according to claim 1, wherein said I stirring and/or said II adding is carried out while stirring the components with a mixer wherein an axis of revolution is connected with two or more axes of rotations, and wherein agitation blades arranged in each of the axes of rotations perform planetary movements.

5. The method according to claim 1, wherein the resin having an acidic group comprises a polyester-based resin.

6. The method according to claim 1, wherein the basic dispersant comprises a basic dispersant having an amino group and/or an imino group.

7. The method according to claim 1, wherein the stirring time in said I stirring is 0.5 minutes or more and 180 minutes or less.

8. The method according to claim 1, wherein the dropping rate of the insulating liquid in said II adding is 0.1 g/min or more and 100 g/min or less per 100 g of said stirred mixture.

9. The method according to claim 1, wherein the content of the resin binder in said stirred mixture is 50% by mass or more.

10. The method according to claim 1, wherein the conductivity of the insulating liquid is $1.0\times10^{-11}$ S/m or less and $1.0\times10^{-13}$ S/m or more.

11. The method according to claim 1, wherein the viscosity of the insulating liquid at 25° C. is 0.5 mPa·s or more and 100 mPa·s or less.

12. A method for producing a liquid developer comprising a resin binder comprising a resin having an acidic group, a colorant, a basic dispersant, and an insulating liquid, comprising:

i: stirring raw materials comprising the resin binder and the basic dispersant at a temperature of equal to or higher than a glass transition temperature of the resin binder, to obtain a stirred mixture;

ii: adding dropwise from 50 to 500 parts by mass of the insulating liquid to said stirred mixture, based on 100 parts by mass of said stirred mixture at a temperature of equal to or higher than a glass transition temperature of the resin binder, thereby carrying out a phase inversion emulsification, to obtain a dispersion of toner particles; and iii: mixing said dispersion with the colorant.

13. The method according to claim 12, wherein said i stirring and/or said ii adding is carried out while stirring the components with a mixer wherein an axis of revolution is connected with two or more axes of rotations, and wherein agitation blades arranged in each of the axes of rotations perform planetary movements.

14. The method according to claim 12, wherein the resin having an acidic group comprises a polyester-based resin.

15. The method according to claim 12, wherein the basic dispersant comprises a basic dispersant having an amino group and/or an imino group.

16. The method according to claim 12, wherein the stirring time in said i stirring is 0.5 minutes or more and 180 minutes or less.

17. The method according to claim 12, wherein the dropping rate of the insulating liquid in said ii adding is 0.1 g/min or more and 100 g/min or less per 100 g of said stirred mixture.

18. The method according to claim 12, wherein the content of the resin binder in said stirred mixture is 50% by mass or more.

19. The method according to claim 12, wherein the conductivity of the insulating liquid is $1.0\times10^{-11}$ S/m or less and $1.0\times10^{-13}$ S/m or more.

20. The method according to claim 12, wherein the viscosity of the insulating liquid at 25° C. is 0.5 mPa·s or more and 100 mPa·s or less.

* * * * *